US011653814B2

(12) United States Patent
Schiele et al.

(10) Patent No.: US 11,653,814 B2
(45) Date of Patent: May 23, 2023

(54) DISHWASHER, METHOD FOR OPERATING A DISHWASHER, AND COMPUTER PROGRAM PRODUCT

(71) Applicants: BSH Hausgeräte GmbH, Munich (DE); Reckitt Benckiser (Brands) Limited, Slough (GB)

(72) Inventors: Alexander Schiele, Herbrechtingen (DE); Jakob Schultz, Dillingen (DE); Georg Walther, Munich (DE); Daniel Miller, Finningen (DE); Alberto Buogo, Lincoln (GB); Addie Muentzenberger, Heidelberg (DE); Anne-Katrin Späte, Heidelberg (DE)

(73) Assignee: BSH Hausergäte GmbH, Munich (DE)

( * ) Notice: Subject to any disclaimer, the term of this patent is extended or adjusted under 35 U.S.C. 154(b) by 82 days.

(21) Appl. No.: 17/269,287

(22) PCT Filed: Aug. 28, 2019

(86) PCT No.: PCT/EP2019/073014
§ 371 (c)(1),
(2) Date: Feb. 18, 2021

(87) PCT Pub. No.: WO2020/043799
PCT Pub. Date: Mar. 5, 2020

(65) Prior Publication Data

US 2021/0251461 A1 Aug. 19, 2021

(30) Foreign Application Priority Data

Aug. 29, 2018 (DE) ..... 10 2018 214 652.7

(51) Int. Cl.
*A47L 15/42* (2006.01)
*A47L 15/00* (2006.01)
*A47L 15/44* (2006.01)

(52) U.S. Cl.
CPC ..... *A47L 15/0057* (2013.01); *A47L 15/0049* (2013.01); *A47L 15/4463* (2013.01);
(Continued)

(58) Field of Classification Search
None
See application file for complete search history.

(56) References Cited

U.S. PATENT DOCUMENTS

2007/0062564 A1* 3/2007 Farano ..... A47L 15/4463 68/17 R
2012/0111366 A1* 5/2012 Baldwin ..... A47L 15/4293 312/228

(Continued)

FOREIGN PATENT DOCUMENTS

EP 1929920 A1 6/2008
EP 2502542 A1 9/2012

(Continued)

OTHER PUBLICATIONS

International Search Report PCT/EP2019/073014 dated Dec. 9, 2019.

*Primary Examiner* — Mikhail Kornakov
*Assistant Examiner* — Ryan L Coleman
(74) *Attorney, Agent, or Firm* — Michael E. Tschupp; Andre Pallapies; Brandon G Braun

(57) ABSTRACT

Dishwasher, in particular household dishwasher, with a washing compartment a control device for carrying out a washing program from a number of washing programs and with an automatic dosing device for automatically dosing a plurality of dosing quantities from a supply a cleaning agent present as a solid in the washing area, the control device for cleaning the automatic dosing device being set up to control the automatic dosing device to switch to a cleaning state and to control the automatic dosing device for cleaning the (Continued)

automatic Dosing device to carry out a specific wash program from the number of wash programs.

14 Claims, 4 Drawing Sheets

(52) U.S. Cl.
CPC ..... *A47L 2401/02* (2013.01); *A47L 2501/26* (2013.01); *A47L 2501/34* (2013.01)

(56) References Cited

U.S. PATENT DOCUMENTS

| | | | | |
|---|---|---|---|---|
| 2013/0220374 | A1* | 8/2013 | Heidel | A47L 15/4244 134/18 |
| 2016/0000297 | A1* | 1/2016 | Hodapp, Jr. | A47L 15/0049 134/93 |
| 2017/0296030 | A1* | 10/2017 | VanderRoest | A47L 15/4409 |

FOREIGN PATENT DOCUMENTS

| | | | |
|---|---|---|---|
| EP | 3173004 | A1 | 5/2017 |
| WO | 2011138146 | A2 | 11/2011 |

* cited by examiner

DISHWASHER, METHOD FOR OPERATING A DISHWASHER, AND COMPUTER PROGRAM PRODUCT

CROSS-REFERENCES TO RELATED APPLICATIONS

This application is the U.S. National Stage of International Application No. PCT/EP2019/073014, filed Aug. 28, 2019, which designated the United States and has been published as International Publication No. WO 2020/043799 A1 and which claims the priority of German Patent Application, Serial No. 10 2018 214 652.7, filed Aug. 29, 2018, pursuant to 35 U.S.C. 119(a)-(d).

BACKGROUND OF THE INVENTION

The present invention relates to a dishwasher, a method for operating a dishwasher and a computer program product.

Dishwashers which have an automatic dosing device are known. Such an automatic dosing device is designed to store a quantity of a cleaning agent and to supply a dosing quantity of the stored cleaning agent to the washing chamber of the dishwasher when a washing program is run.

Such an automatic dosing device may have movable components in order to achieve the automatic dosing of the dosing quantity. Due to contaminants the automatic dosing device may be functionally impaired. A cleaning of the washing items is thus no longer ensured.

BRIEF SUMMARY OF THE INVENTION

Against this background, an object of the present invention is to propose an improved dishwasher.

According to a first feature, a dishwasher, in particular a household dishwasher, is proposed, comprising a washing chamber, a controller for running a washing program from a number of washing programs, and an automatic dosing device. The automatic dosing device is designed for automatically dosing a plurality of dosing quantities from a supply of cleaning agent provided as a solid material, which comprises a plurality of dosing quantities, into the washing chamber. The controller is designed to clean the automatic dosing device, actuate the automatic dosing device so as to switch same to a cleaning state, and run a specific washing program to clean the automatic dosing device.

This dishwasher has the advantage that the automatic dosing device may be cleaned in a simple and thorough manner. In particular, the function of the automatic dosing device may be ensured thereby. Moreover, the cleaning of the automatic dosing device may be carried out automatically without a user having to carry out the cleaning of the dishwasher.

The controller may be implemented by hardware technology and/or software technology. In the case of an implementation by hardware technology, the controller may be configured, for example, as a computer or as a microprocessor. In the case of an implementation by software technology, the controller may be configured as a computer program product, as a function, as a routine, as part of a program code or as an object which may be executed.

The automatic dosing device is designed for automatically dosing a plurality of dosing quantities of cleaning agent. This is understood to mean, in particular, that the automatic dosing device, when actuated by a controller of the dishwasher, for example, doses a dosing quantity of the cleaning agent into the washing chamber. To this end, the automatic dosing device comprises, for example, a removal unit for removing the dosing quantity from the supply of cleaning agent. The supply is kept available in the dishwasher. The removed dosing quantity may then be directly supplied into the washing chamber or even via an interposed device, in particular a supply channel, which is advantageously designed to separate the removal unit and the washing chamber in a fluid-tight manner.

The automatic dosing device is designed, in particular, to receive a supply of cleaning agent, wherein the supply may comprise a quantity of the cleaning agent which corresponds to a multiple of the dosing quantity, for example 10 times, 20 times or even 50 times the dosing quantity. Thus the automatic dosing device advantageously makes it possible to run a plurality of washing cycles by means of the dishwasher without a user having to refill the cleaning agent.

For example, the supply comprises up to 500 ml or 500 g of the cleaning agent and the dosing quantity comprises 10 ml or 10 g of the cleaning agent. Thus in the first instance when the supply is completely full, 50 times the dosing quantity may be removed therefrom before the supply is used up.

The dosing quantity is determined by way of example such that lightly soiled washing items may be cleaned thereby. In the case of more heavily soiled washing items, the total dosing may be increased by repeated dosing of the dosing quantity. In embodiments of the automatic dosing device, the dosing quantity may be extremely small, for example one milligram, so that the total dose of the cleaning agent is able to be very finely adjusted.

The cleaning agent is present, in particular, as a solid. The cleaning agent comprises, in particular, cleaning agent particles which, for example, have a size of a few micrometers to a few millimeters in diameter. In the case of particle sizes up to approximately 1 mm, for example, this is referred to as powder. In the case of particle sizes in the range of up to approximately 5 mm, for example, this is referred to as pellets or tablets. Advantageously, the cleaning agent is pourable or free-flowing. In this case free-flowing or pourable is understood, in particular, to mean that the cleaning agent behaves like a liquid under the action of gravity.

When the dishwasher is used, over time it may arise that dirt collects in the automatic dosing device and/or that cleaning agent residues, which during the dosing process remain stuck to a surface along a dosing path, clump together. This may lead to a blockage of a channel or to a blocking of a component. In order to avoid this, the automatic dosing device may be cleaned by means of the specific washing program.

In particular, it is provided that the cleaning of the automatic dosing device is carried out or recommended regularly, for example after a specific number of washing cycles by the dishwasher or after a specific time period and/or in an event-controlled manner, for example when a blocking of a component of the automatic dosing device is established.

For running the cleaning, the automatic dosing device is set into a cleaning state by the controller. The cleaning state may be characterized, for example, in that movable components or elements are moved into a specific position. Moreover, it may be provided that at least some elements are able to be dismantled by a user from the automatic dosing device when it is in the cleaning state.

The specific washing program is designed, in particular, for automatically cleaning the automatic dosing device. Washing program parameters, such as for example a running time, a water quantity, a washing liquor temperature and/or a circulating pump speed, may be specifically selected or predetermined. Advantageously, the specific washing program has a short running time compared to the further washing programs which are designed for washing the washing items, so that the dishwasher may be used again for washing the washing items after a short time.

It may be provided that the specific washing program is integrated as a sub-program step of a washing program for washing the washing items. For example, after a cleaning sub-program step of a normal washing program, when the washing items are already cleaned and thus free of soiling, the controller is designed to run the specific washing program as a sub-program step. In particular, the controller is designed to run this automatically, i.e. without additional user interaction. For example, during the running of a washing program for washing the washing items, the controller determines that the automatic dosing device requires cleaning or is in a state in which a cleaning may be carried out, whereupon the recently carried out washing program is complemented by the sub-program step of the specific washing program. Advantageously this takes place, for example, before a rinsing sub-program step of the washing program.

According to an embodiment of the dishwasher, the automatic dosing device has a dosing unit which is arranged in a first fluid-tight housing of the automatic dosing device for dosing the dosing quantity, wherein the first housing has a cleaning opening which is closable in a fluid-tight manner and which is at least intermittently open in the cleaning state of the automatic dosing device.

The fluid-tight housing protects the dosing unit from dirt and moisture during normal operation of the dishwasher. The dosing unit is accessible from outside via the cleaning opening, in particular for cleaning and/or maintenance purposes. The cleaning opening is closable, for example, by means of a flap or a cover. The flap or the cover in the closed state are, in particular, mechanically locked such that an inadvertent opening of the cleaning opening is excluded. In the cleaning state of the automatic dosing device the cleaning opening is open. For example, the flap or the cover is unlocked so that the user may open the flap or the cover by means of pivoting and/or completely remove the flap or the cover from the automatic dosing device. It may also be provided that a drive means, for example a spring and/or an electric motor, automatically pivots the flap or the cover when the locking is released.

According to a further embodiment of the dishwasher, the automatic dosing device has a receiving unit which is arranged in a second fluid-tight housing of the automatic dosing device for receiving a removable storage container for providing the supply of cleaning agent, wherein the second housing has a cleaning opening which is closable in a fluid-tight manner and which is at least intermittently open in the cleaning state of the automatic dosing device.

The fluid-tight housing protects the receiving unit and the storage container from dirt and moisture during normal operation of the dishwasher. On the one hand, the receiving unit is accessible for cleaning and maintenance purposes via the cleaning opening. On the other hand, the removable storage container may be removed and inserted when the cleaning opening is open. The cleaning opening is closable, for example, by means of a flap or a cover. The flap or the cover in the closed state are, in particular, mechanically locked so that an inadvertent opening of the cleaning opening is excluded. In the cleaning state of the automatic dosing device, the cleaning opening is open. For example the flap or the cover is unlocked so that the user may open the flap or the cover by means of pivoting and/or completely remove the flap or the cover from the automatic dosing device. It may also be provided that a drive means, for example a spring and/or an electric motor, pivots the flap or the cover automatically when the locking is released.

According to a further embodiment of the dishwasher, the automatic dosing device has a supply channel which is closable in a fluid-tight manner in order to connect the automatic dosing device to the washing chamber in terms of flow technology, wherein the supply channel which is closable in a fluid-tight manner is open in the cleaning state of the automatic dosing device.

The supply channel is arranged, in particular, between the dosing unit and the washing chamber. During a washing cycle, the supply channel is preferably closed in a fluid-tight manner so that the dosing unit is not subjected to the moisture in the washing chamber. For the dosing process, in particular, it may be provided that the dosing unit is predosed into the closed supply channel and then the supply channel is briefly opened in order to dispense the predosed cleaning agent into the washing chamber.

The supply channel is susceptible to a greater extent to influences from the washing chamber which, for example, may be detrimental to the sealing function thereof. It may be provided that a flap is arranged on the opening of the supply channel into the washing chamber for the covering thereof, in particular for closing the supply channel in a manner which is tight relative to spray water and/or fluid. In the cleaning state of the automatic dosing device the supply channel and a possibly provided flap are open, so that a connection is produced in terms of flow technology between the dosing unit and the washing chamber. Thus washing liquor may penetrate into the supply channel and rinse through this supply channel so that dirt and/or encrusted cleaning agent residues may be reliably removed from the supply channel.

According to a further embodiment of the dishwasher, the automatic dosing device has a drive means for driving at least one movable element for dosing the dosing quantity, wherein the controller is designed to actuate the drive means to move the movable element when the specific washing program is run.

The movable element comprises, in particular, a worm gear, a gearwheel, a linear actuator and the like. The movable element is movable in a specific movement range, for example pivotable or rotatable over a specific angular range. The movable element is moved, in particular, at least once over the entire movement range, preferably moved repeatedly over the entire movement range. For example, a worm gear is rotated back and forth. In this manner a thorough cleaning of the movable element is ensured.

According to a further embodiment of the dishwasher, the movable element is assigned a sensor unit for the detection of a movement of the movable element and for the output of a sensor signal as a function of the detected movement, wherein the controller is designed to identify a blocking of the movable element as a function of the sensor signal.

In this embodiment, it is detected when the movable element is blocked. A blocked movable element may lead to the malfunction of the automatic dosing device. In this embodiment corresponding counter measures, in particular a cleaning of the automatic dosing device, may thus be carried out in a targeted manner.

Advantageously the sensor unit detects, for example, a motor current and/or a voltage of an electric motor of the movable element as the sensor signal. In particular, the sensor unit may also be integrated in the controller as a function and/or by hardware, so that a separate sensor unit may be dispensed with.

According to a further embodiment of the dishwasher, the automatic dosing device is designed to dose cleaning agent powder, cleaning agent pellets or shaped bodies consisting of cleaning agent.

According to a further embodiment of the dishwasher, a user interface is provided for the output of user information as a function of the cleaning state and/or the identified blocking of the movable element of the automatic dosing device.

In this embodiment the user may be informed, for example, that a movable element of the automatic dosing device is blocked and that the automatic dosing device should be cleaned. The user information may comprise, in particular, various other items of information, in particular instructions for cleaning the automatic dosing device.

The user interface comprises, for example, a display on a front face of the household dishwasher and/or a data interface, in particular for wireless data transmission, such as for example WLAN, Bluetooth® and/or a mobile radio interface. By means of a data interface, the user information may be transmitted, for example, to a connected device of the user, for example a mobile device, such as a smartphone or a tablet, and correspondingly output from the device.

According to a further embodiment of the dishwasher, said dishwasher has a specific hydraulic system for the specific washing program.

A specific hydraulic system comprises, in particular, valves, nozzles, water-conducting elements and the like. A targeted cleaning of the automatic dosing device may be carried out by such a specific hydraulic system. It may be provided that the specific hydraulic system is removable and that a user or service personnel inserts the specific hydraulic system into the dishwasher in order to run the specific washing program.

According to a further embodiment of the dishwasher, said dishwasher has a supply unit for supplying an individual dose of a further cleaning agent. The controller is designed to actuate the supply unit for supplying the further cleaning agent when the specific washing program is run.

The supply unit may have, in particular, a container which may be filled manually by the user with the further cleaning agent before a washing cycle. The supply unit may be used, in particular, for supplying the further cleaning agent when the automatic dosing device is cleaned by means of the specific washing program. The further cleaning agent, in particular, is a specific cleaning agent but may also be a cleaning agent to be used for washing the washing items.

In embodiments it may be provided that for cleaning the automatic dosing device, a specific cleaning agent is dispensed into the washing chamber and/or instead of the storage container a specific cleaning cartridge is provided with the cleaning agent in the receiving unit. The cleaning cartridge has the advantage that the contents thereof may be dispensed via the dosing path which the cleaning agent also takes during the dosing by the automatic dosing device when the automatic dosing device is cleaned. The cleaning cartridge comprises, in particular, a liquid cleaning agent.

Moreover, the cleaning cartridge may have a mechanical cleaning agent, in particular brushes. By the cleaning cartridge being moved in the receiving unit, for example by being rotated, a mechanical cleaning action may be achieved by the brushes.

According to a second feature a method for operating a dishwasher, in particular a household dishwasher, is proposed, comprising a washing chamber, a controller for running a washing program from a number of washing programs, and an automatic dosing device for automatically dosing a plurality of dosing quantities of a cleaning agent from a supply of cleaning agent, comprising a plurality of dosing quantities, into the washing chamber. In a first method step, the controller actuates the automatic dosing device for switching to a cleaning state. In a second method step the controller runs a specific washing program for cleaning the automatic dosing device.

This method may be carried out, for example, by a dishwasher according to the first feature.

Moreover, a computer program product which executes the implementation of the above-described method on a program-controlled device is proposed.

A computer program product, such as for example a computer program means, may be provided or delivered, for example, as a storage medium, such as for example a memory card, USB stick, CD-ROM, DVD or even in the form of a downloadable data file from a server in a network. This may be carried out, for example, in a wireless communication network, by the transmission of a corresponding data file with the computer program product or the computer program means.

The embodiments and features described for the proposed device accordingly apply to the proposed method.

Further possible implementations of the invention also comprise not explicitly cited combinations of features or embodiments described above or below relative to the exemplary embodiments. In this case, the person skilled in the art will also add individual features as improvements or additions to the respective basic form of the invention.

BRIEF DESCRIPTION OF THE DRAWINGS

Further advantageous embodiments and features of the invention form the subject matter of the subclaims and the exemplary embodiments of the invention described hereinafter. The invention is described in more detail below by means of preferred embodiments, with reference to the accompanying figures.

DETAILED DESCRIPTION OF EXEMPLARY EMBODIMENTS OF THE PRESENT INVENTION

Figure 1:
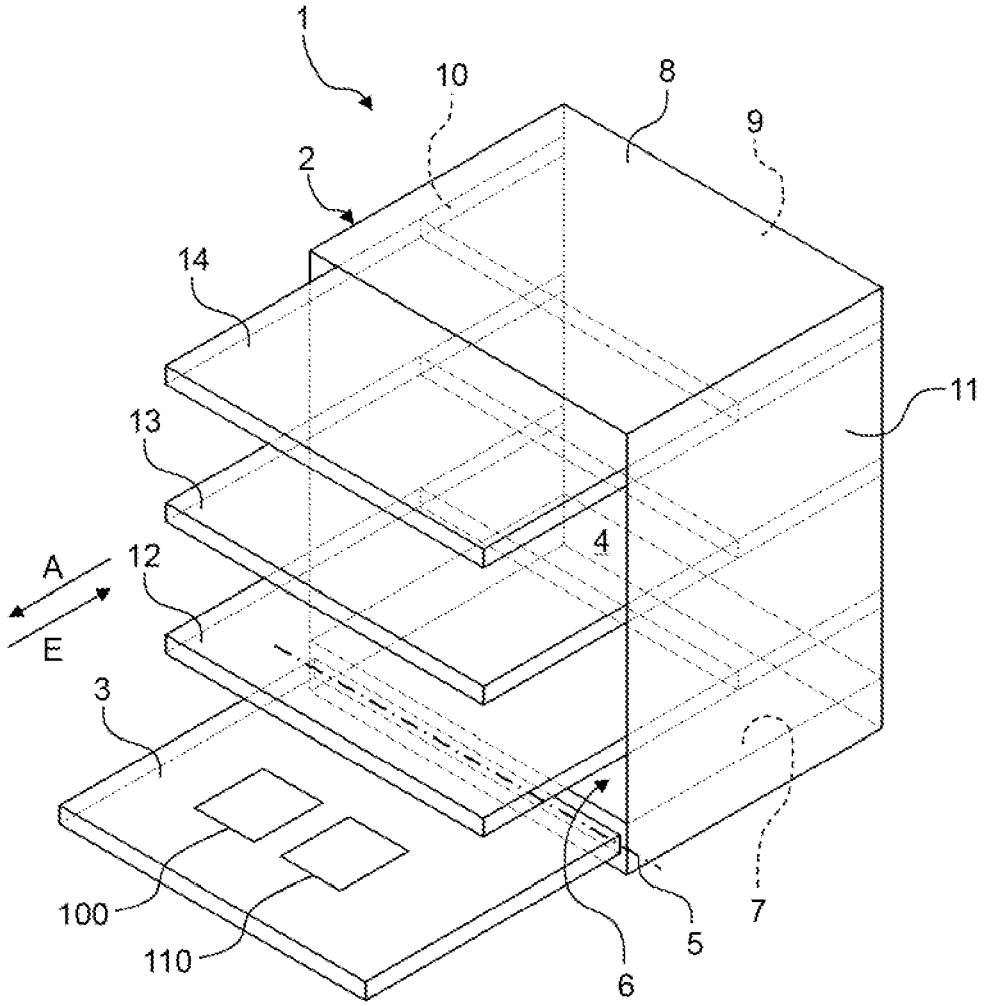
FIG. 1 shows a schematic perspective view of an exemplary embodiment of a dishwasher.

Elements which are identical or functionally identical have been provided in the figures with the same reference numerals, unless indicated otherwise.

FIG. 1 shows a schematic perspective view of an embodiment of a dishwasher 1 which is configured here as a household dishwasher. The household dishwasher 1 comprises a washing container 2 which is closable by a door 3, in particular in a water-tight manner. To this end, a sealing device may be provided between the door 3 and the washing container 2. The washing container 2 is preferably cuboidal. The washing container 2 may be arranged in a housing of the household dishwasher 1. The washing container 2 and the door 3 may form a washing chamber 4 for washing the washing items.

The door 3 is shown in FIG. 1 in its open state. The door 3 may be closed or opened by pivoting about a pivot axis 5 provided at a lower end of the door 3. A loading opening 6 of the washing container 2 may be closed or opened by means of the door 3. The washing container 2 has a bottom 7, a ceiling 8 arranged opposite the bottom 7, a rear wall 9 arranged opposite the closed door 3 and two side walls 10, 11 arranged opposite one another. The bottom 7, the ceiling 8, the rear wall 9 and the side walls 10, 11 may be produced, for example, from stainless steel. Alternatively, the bottom 7 may be produced, for example, from a plastics material.

The household dishwasher 1 further comprises at least one washing item receptacle 12 to 14. Preferably a plurality of washing item receptacles 12 to 14, for example three thereof, may be provided, wherein the washing item receptacle 12 may be a lower washing item receptacle or a lower basket, the washing item receptacle 13 may be an upper washing item receptacle or an upper basket and the washing item receptacle 14 may be a cutlery drawer. As FIG. 1 also shows, the washing item receptacles 12 to 14 are arranged one above the other in the washing container 2. Each washing item receptacle 12 to 14 is optionally able to be displaced into or out of the washing container 2. In particular, each washing item receptacle 12 to 14 is able to be pushed or retracted into the washing container 2 in an insertion direction E and is able to be pulled or extended out of the washing container 2 counter to the insertion direction E in an extension direction A.

Furthermore a controller 100 and an automatic dosing device 110 are arranged on the door 3 of the household dishwasher 1. The controller 100 is provided for controlling, regulating and/or monitoring all of the controllable components of the household dishwasher 1, such as valves, pumps, heater, water switch, supply unit and the like, which are not shown for reasons of clarity. In particular, the controller 100 is designed to actuate the automatic dosing device 110. With a corresponding actuation by the controller 100, the automatic dosing device 110 is designed to dose one or more dosing quantities of a solid cleaning agent into the washing chamber 4. To this end, the automatic dosing device 110, for example, has a dosing unit 114 (see FIG. 3). The automatic dosing device 110 may also have further components/elements, such as a fluid-tight housing 112, a cleaning opening 113, a receiving unit 118, a supply channel 120, a sealing unit 121, a movable element 122 and/or a sensor unit 123 (see FIG. 2 and FIG. 3).

The controller 100 is designed to run a washing program from a number of washing programs. The number comprises, for example, a plurality of respectively different washing programs for washing the washing items, such as for example a delicate program, an intensive program, an energy-saving program, etc. Furthermore, the number comprises at least one specific washing program which is provided for cleaning the automatic dosing device 110 and has specific washing parameters therefor. Hereinafter, the specific washing program may be denoted as a cleaning program.

Figure 2:
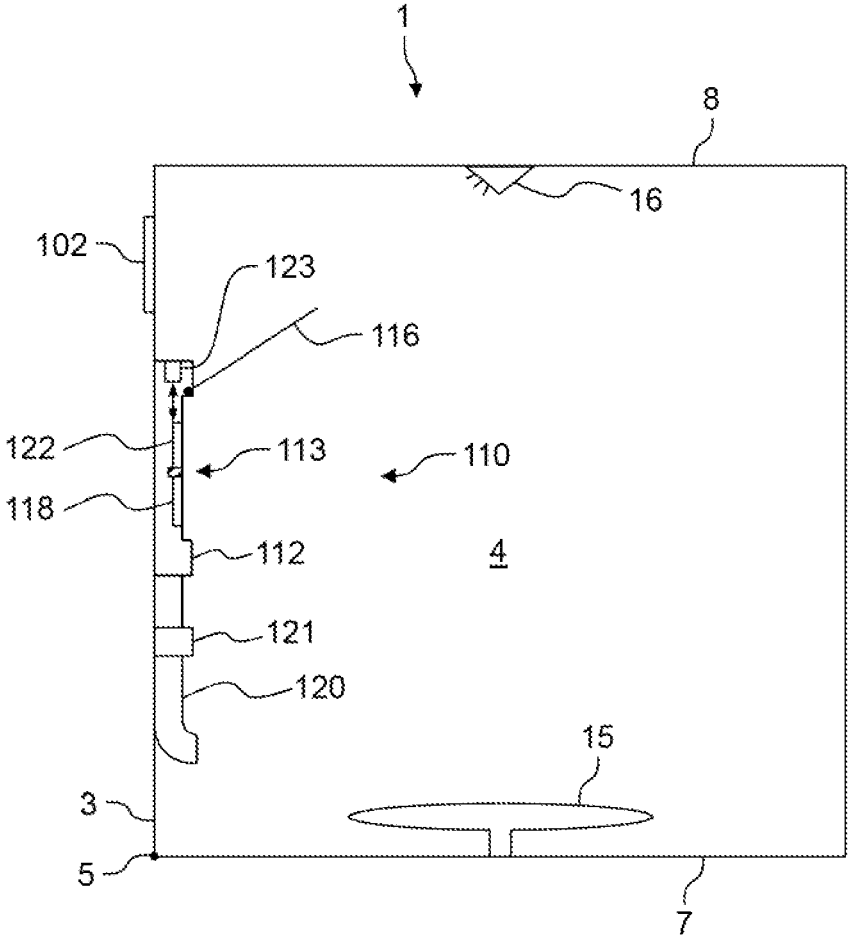
FIG. 2 shows a schematic side view of a further exemplary embodiment of a dishwasher in the cleaning state.

FIG. 2 shows a schematic side view of a further exemplary embodiment of a dishwasher 1 which is configured once again as a household dishwasher 1 which is currently in the cleaning state. The dishwasher 1 shown, for example, may be the household dishwasher 1 of FIG. 1. The household dishwasher 1 is shown here with the door 3 in the closed position. A spray arm 15 which in normal operation of the household dishwasher 1 is designed to supply the washing items in the washing chamber 4 with washing liquor is arranged on a bottom 7 of the household dishwasher 1. A specific hydraulic system 16 which may be specifically used for cleaning the automatic dosing device 110 is arranged on a ceiling 8 of the household dishwasher 1. A user interface 102 is arranged on the outer face of the door 3, said user interface in this case comprising a digital display and user information being able to be output thereby. The user information comprises, for example, a message that a movable element 122 of the automatic dosing device 110 is blocked, which is why the automatic dosing device 110 should be cleaned.

The automatic dosing device 110 is arranged on the inner face of the door 3. The automatic dosing device 110 comprises a receiving unit 118 which is arranged in a fluid-tight housing 112 for receiving a removable storage container, which has been removed in the present case. The receiving unit 118 in this case is rotatable about an axis, so that in the inserted state the storage container may be rotated with the receiving unit 118. The receiving unit 118 in this case forms a movable element 122 of the automatic dosing device 110. The receiving unit 118 is accessible by means of a cleaning opening 113 which is closable by a flap 116 in a fluid-tight manner. A sensor unit 123, which is designed to detect a movement of the receiving unit 118, is arranged in the upper region of the fluid-tight housing 112. A supply channel 120, which is closable in a fluid-tight manner by a sealing element 121, adjoins the fluid-tight housing 112.

The automatic dosing device 110 is shown in its cleaning state which in the present case is characterized by the flap 116 being open, the storage container being removed and the sealing element 121 being open. Thus the automatic dosing device 110 may be efficiently cleaned when the controller 100 (see FIG. 1) runs the cleaning program. During the cleaning program, in particular, the specific hydraulic system 16 is supplied at least intermittently with washing liquor.

Figure 3:
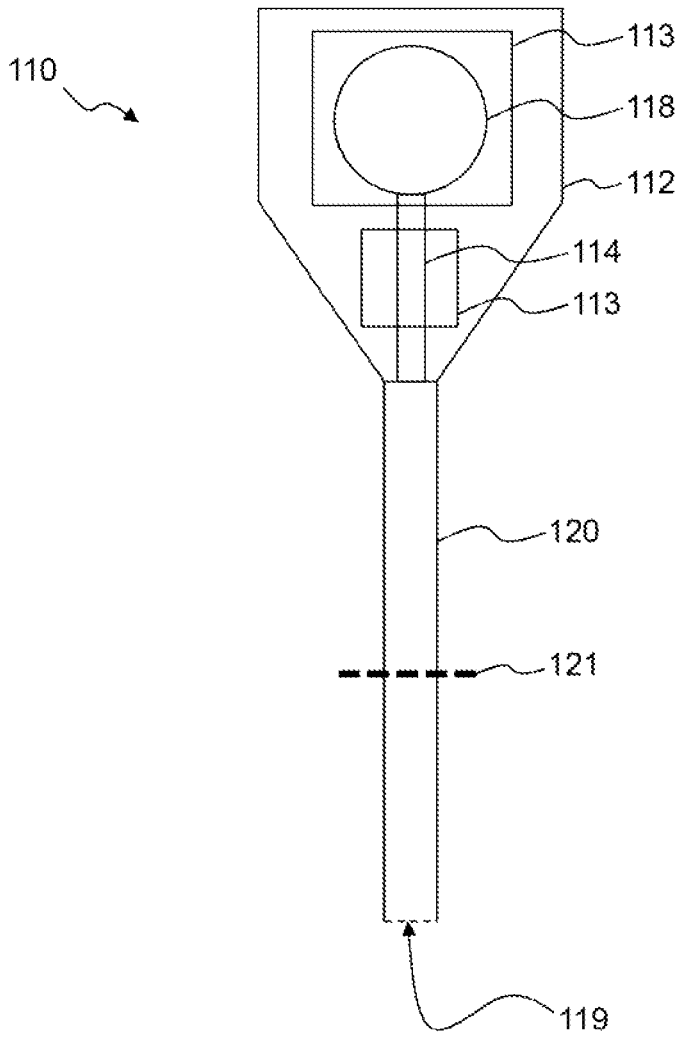
FIG. 3 shows schematically an exemplary embodiment of an automatic dosing device.

FIG. 3 shows a schematic exemplary embodiment of an automatic dosing device 110, as may be used for example in the household dishwasher 1 of FIG. 1 or FIG. 2. In the present case the automatic dosing device 110 comprises a receiving unit 118 for receiving a removable storage container (not shown) which in this exemplary embodiment has a round shape. In this case the receiving unit 118 is designed such that the storage container is rotatable therein, wherein the dosing or a predosing is effected by a rotation of the storage container. The receiving unit 118 is arranged in a housing 112 which is closable in a fluid-tight manner and is accessible via a cleaning opening 113. The cleaning opening 113 is closable, in particular, in a fluid-tight manner by a flap 116 (see FIG. 2). In the open state of the cleaning opening 113 the flap 116 may be flapped open by a user or even automatically. Then the storage container may be removed, for example, and the receiving unit 118 may be cleaned unhindered.

A dosing unit 114 is also arranged in the fluid-tight housing 112. The dosing unit 114 monitors, for example, the dosing of the dosing quantity from the storage container into the washing chamber 4 (see FIG. 1 and FIG. 2). The dosing unit 114 is accessible via a cleaning opening 113, as is the receiving unit 118.

The automatic dosing device 110 also has a supply channel 120 which, in particular, connects the dosing unit 114 in terms of flow technology to the washing chamber 4, wherein at the lower end of the supply channel 120 an outlet 119 opens into the washing chamber 4. A sealing element 121, which is designed for the fluid-tight sealing of the supply channel 120, is arranged on the supply channel 120. For example, the supply channel 120 consists of a squeezable hose and the sealing element 121 is configured in the form of a clip which is designed to squeeze the squeezable hose. The outlet 119 may be closed, for example, by an openable flap (not shown).

In the cleaning state of the automatic dosing device 110, in particular, at least one of the two cleaning openings 113 is in the open state. Thus the housing 112 is not closed in a fluid-tight manner. Moreover, it may be provided that in the cleaning state of the receiving unit 118 the storage container is removed. The sealing element 121 is also open so that a connection in terms of flow technology is present between the dosing unit 114 and the washing chamber 4. In particular, the washing liquor which is dispensed so as to be directed toward the open cleaning opening 113 is able to penetrate via the respective cleaning opening 113 into the automatic dosing device 110 and release dirt and/or encrusted cleaning agent therein and thus clean the automatic dosing device 110. The penetrated washing liquor is able to drain out via the supply channel 120 back into the washing chamber 4.

Figure 4:
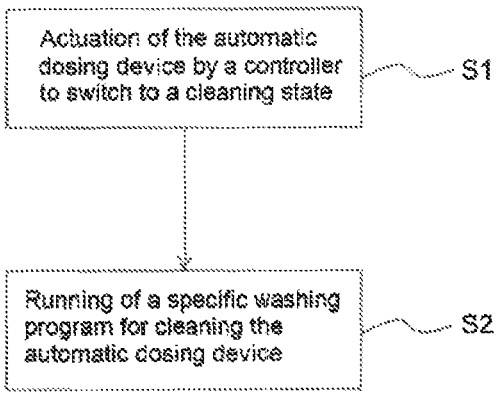
FIG. 4 shows a schematic block diagram of an exemplary embodiment of a method for operating a dishwasher.

FIG. 4 shows a schematic block diagram of an exemplary embodiment of a method for operating a dishwasher 1, for example the household dishwasher 1 of FIG. 1 or FIG. 2. The dishwasher 1 has a controller 100 and an automatic dosing device 110.

In a first method step S1 the automatic dosing device 110 is actuated by a controller 100 of the dishwasher 1 for switching to a cleaning state. In particular, cleaning openings 113 which are present to this end (see FIG. 2 and FIG. 3) are opened so that soiled components of the automatic dosing device 110 may be cleaned.

In a second method step S2 a specific washing program for cleaning the automatic dosing device 110 is run. The specific washing program may be provided, in particular, such that movable components of the automatic dosing device 110, such as for example a receiving unit 118 and/or a dosing unit 114 (see FIG. 3), are deflected or moved during the running of the specific washing program so that potentially concealed portions are also cleaned. For example, a rotatable receiving unit 118, as shown in FIG. 2 or FIG. 3, is repeatedly rotated, preferably in both rotational directions.

Whilst the present invention has been described with reference to exemplary embodiments, it may be modified in many different ways.

The invention claimed is:

1. A dishwasher, comprising:

a washing chamber;

an automatic dosing device configured to contain a supply of solid cleaning agent and to automatically dose a plurality of dosing quantities from the supply of solid cleaning agent, the automatic dosing device comprising:

a cleaning opening that is openable to receive washing liquor in a cleaning state for cleaning the automatic dosing device; and a supply channel that is openable to drain the washing liquor from the automatic dosing device in the cleaning state, the cleaning opening positioned above the supply channel in the cleaning state; and a controller for running a number of washing programs, said controller being configured to run from the number of washing programs a specific washing program by which the automatic dosing device is actuated and switched to the cleaning state for cleaning the automatic dosing device using the specific washing program.

2. The dishwasher of claim 1, constructed in the form of a household dishwasher.

3. The dishwasher of claim 1, wherein the automatic dosing device includes a fluid-tight housing and performs dosing of cleaning agent within said housing, said housing having the cleaning opening, and wherein the cleaning opening is closable in a fluid-tight manner.

4. The dishwasher of claim 1, wherein the automatic dosing device includes a fluid-tight housing and is configured to receive a removeable storage container for providing the supply of the solid cleaning agent, said housing having the cleaning opening and wherein the cleaning opening is closable in a fluid-tight manner.

5. The dishwasher of claim 1, wherein the supply channel is closable in a fluid-tight manner, and wherein the supply channel connects the automatic dosing device to the washing chamber.

6. The dishwasher of claim 1, wherein the automatic dosing device includes a movable element and a drive driving the movable element for dosing the dosing quantities, said controller being designed to actuate the drive to move the movable element when the specific washing program is run.

7. The dishwasher of claim 6, wherein the automatic dosing device includes a sensor that detects a movement of the movable element and outputs a sensor signal as a function of the detected movement of the movable element, said controller designed to identify a blocking of the movable element as a function of the sensor signal.

8. The dishwasher of claim 6, wherein the cleaning agent is selected from a group consisting of cleaning agent powder, cleaning agent pellets, and shaped bodies of cleaning agent.

9. The dishwasher of claim 6, further comprising a user interface configured to output user information as a function of the cleaning state and/or an identified blocking of the movable element of the automatic dosing device.

10. The dishwasher of claim 1, further comprising a hydraulic system for cleaning the automatic dosing device, when the specific washing program is run.

11. The dishwasher of claim 1, wherein the controller is designed to cause supply of further cleaning agent from a supply unit when the specific washing program is run.

12. A method for operating a dishwasher which includes a washing chamber, a controller for running a washing program from a number of washing programs, and an automatic dosing device configured to contain a supply of solid cleaning agent and to automatically dose a plurality of dosing quantities from the supply of solid cleaning agent, said method comprising:

actuating, by the controller, the automatic dosing device to switch to a cleaning state by:

opening a cleaning opening of the automatic dosing device for receiving washing liquor to remove residue from the automatic dosing device; and opening a supply channel of the automatic dosing device for draining the washing liquor and the residue from the automatic dosing device, the cleaning opening positioned above the supply channel in the cleaning state; and running a specific washing program for cleaning the automatic dosing device while the automatic dosing device is in the cleaning state such that washing liquid can enter the cleaning opening and flow through the supply channel.

13. The method of claim 12, wherein the dishwasher is a household dishwasher.

14. A computer program product for operating a dishwasher, the computer program product comprising a computer program embodied in a non-transitory computer-readable medium, the computer program executable by a program-controlled device to perform the method recited by claim 12.

* * * * *